US009605497B2

(12) United States Patent
Angelle et al.

(10) Patent No.: US 9,605,497 B2
(45) Date of Patent: Mar. 28, 2017

(54) DRILL PIPE AND CASING ELEVATOR

(71) Applicant: Frank's International, LLC, Houston, TX (US)

(72) Inventors: Jeremy R. Angelle, Youngsville, LA (US); Robert L. Thibodeaux, Lafayette, LA (US); James Fontenot, Youngsville, LA (US); Jacob Chu, Lafayette, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 442 days.

(21) Appl. No.: 14/192,344

(22) Filed: Feb. 27, 2014

(65) Prior Publication Data

US 2015/0240575 A1 Aug. 27, 2015

(51) Int. Cl.

| | |
|---|---|
| ***E21B 19/07*** | (2006.01) |
| ***E21B 19/06*** | (2006.01) |
| ***E21B 19/10*** | (2006.01) |

(52) U.S. Cl.

CPC ..... *E21B 19/07* (2013.01); *E21B 19/06* (2013.01); *E21B 19/10* (2013.01)

(58) Field of Classification Search

CPC ..... E21B 19/07; E21B 19/06; E21B 19/10; E21B 19/02; E21B 19/12; E21B 17/1078; E21B 19/00; E21B 19/16; E21B 19/20; F16L 3/00

See application file for complete search history.

(56) References Cited

U.S. PATENT DOCUMENTS

| | | | | |
|---|---|---|---|---|
| 1,674,144 | A | 6/1928 | Traves | |
| 6,644,413 | B2 | 11/2003 | Adams et al. | |
| 6,920,931 | B1 | 7/2005 | Webre et al. | |
| 7,337,853 | B2 | 3/2008 | Buytaert et al. | |
| 8,082,997 | B2 | 12/2011 | Webre et al. | |
| 2004/0182611 | A1 | 9/2004 | Ramey et al. | |
| 2009/0252589 | A1 | 10/2009 | Sonneveld et al. | |
| 2009/0272542 | A1* | 11/2009 | Begnaud | E21B 19/07 166/380 |
| 2010/0059231 | A1 | 3/2010 | Thomas et al. | |

(Continued)

FOREIGN PATENT DOCUMENTS

| | | | |
|---|---|---|---|
| EP | 1470353 | B1 | 8/2007 |
| WO | 2005003504 | A2 | 1/2005 |

OTHER PUBLICATIONS

Jin Ho Kim (Authorized Officer) International Search Report and Written Opinion dated May 22, 2015, International Application No. PCT/US2015/015714, filed Feb. 12, 2015, pp. 1-15.

*Primary Examiner* — Yong-Suk (Philip) Ro

(74) *Attorney, Agent, or Firm* — MH2 Technology Law Group, LLP

(57) ABSTRACT

An apparatus for handling one or more tubulars includes a body defining at least a portion of a tapered bowl. A plurality of slips may be disposed at least partially within the bowl and configured to slide along a surface of the bowl. Each of the slips includes a radial engaging surface and a tapered engaging surface. The radial engaging surface may have a plurality of gripping structures extending inwardly therefrom that are configured to engage an outer surface of a first tubular having a substantially constant outer diameter. The tapered engaging surface may be configured to engage a tapered outer surface of a second tubular.

26 Claims, 9 Drawing Sheets

(56) References Cited

U.S. PATENT DOCUMENTS

| | | | | |
|---|---|---|---|---|
| 2011/0147011 | A1* | 6/2011 | Thibodeaux, Jr. ..... | E21B 19/10<br>166/382 |
| 2012/0067649 | A1 | 3/2012 | Wlson | |
| 2013/0228339 | A1* | 9/2013 | Adams ..... | E21B 19/002<br>166/348 |

* cited by examiner

DRILL PIPE AND CASING ELEVATOR

BACKGROUND

In many oilfield operations (e.g., drilling, running casing, etc.) a tubular is run into the wellbore. During run-in, the tubular is typically connected to (i.e., made-up to) one or more tubulars that have already been run-in, thus providing an end-on-end connection forming a tubular string. In some cases, elevators are employed to position the tubular above the wellbore, allowing the tubular to be made-up to the subjacent, already-run tubular. The elevator then supports the weight of the tubular string through its engagement with the tubular, and lowers the tubular string into the wellbore.

There are several different types of elevators, which employ different structures to engage the tubular and support its weight depending on the type of tubular. For more robust tubulars (e.g., casings), elevators generally employ slips that engage the outer radial surface of the casing. Slip-type elevators generally use the weight of the casing to provide the gripping force, and may include gripping structures or the like that bite into the casing. Slip-type elevators may crush or otherwise damage less robust tubulars (e.g., drill pipes) in deep sea or other applications where the tubular strings can become extremely heavy. As such, a different type of elevator, referred to as a load bushing elevator, is oftentimes used for less robust tubulars (e.g., drill pipes). The load bushing catches an upset of the drill pipe or a lift nubbin connected to the top of the drill pipe. Load bushing elevators, by contrast, provide a collar or landing surface upon which that the upset bears.

SUMMARY

An apparatus for handling one or more tubulars is disclosed. The apparatus may include a body defining at least a portion of a tapered bowl. A plurality of slips may be disposed at least partially within the bowl and configured to slide along a surface of the bowl. Each of the slips may include a radial engaging surface and a tapered engaging surface. The radial engaging surface may have a plurality of gripping structures extending inwardly therefrom that are configured to engage an outer surface of a first tubular having a substantially constant outer diameter. The tapered engaging surface may be configured to engage a tapered outer surface of a second tubular.

An elevator for handling one or more tubulars is also disclosed. The elevator may include a body defining a first portion of a tapered bowl and one or more doors pivotally coupled with the body. The one or more doors may define a second portion of the bowl. A plurality of slips may be disposed at least partially within the bowl and circumferentially-offset from one another about a longitudinal centerline through the body. The slips are configured to slide along a surface of the bowl. Each of the slips may include a radial engaging surface and a tapered engaging surface. The radial engaging surface may have a plurality of gripping structures extending inwardly therefrom that are configured to engage an outer surface of a first tubular having a substantially constant outer diameter. The tapered engaging surface may be configured to engage a tapered outer surface of a second tubular. A plurality of pipe guides may be coupled to the body and positioned below the slips. Each of the pipe guides may be configured to pivot between a first position and a second position when contacted by one of the slips. A distance between an end of each pipe guide and the longitudinal centerline may be less than a distance between the gripping structures on the radial engaging surface and the longitudinal centerline when the pipe guides are in the second position.

A method for handling one or more tubulars is also disclosed. The method may include inserting a first tubular having a substantially constant outer diameter into a body of an elevator. The body may define at least a portion of a tapered bowl. A plurality of slips may be disposed at least partially within the bowl. The slips may move along a surface of the bowl until a radial engaging surface of each slip engages an outer surface of the first tubular. The slips may move along the surface of the bowl to disengage the radial engaging surface of each slip from the outer surface of the first tubular. A second tubular may be inserted into the elevator. The slips may move along the surface of the bowl until a tapered engaging surface of each slip engages a tapered outer surface of the second tubular.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate an embodiment of the present teachings and together with the description, serve to explain the principles of the present teachings. In the figures.

Figure 1:
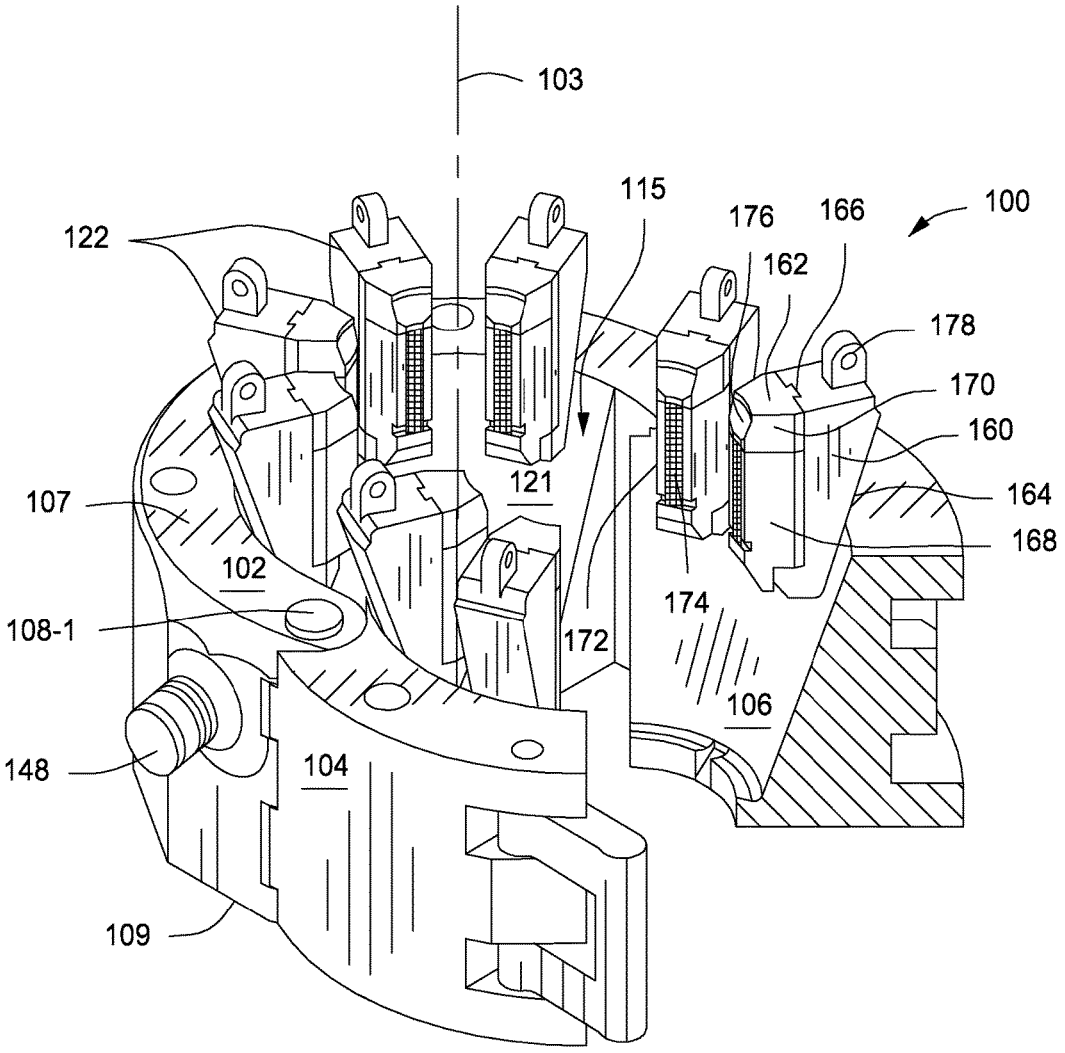
FIG. 1 illustrates a perspective view of an elevator having a pair of doors in an open position and a plurality of slips in a first or "upper" position, according to an embodiment.

It should be noted that some details of the figures have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawings. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

FIG. 1 illustrates a perspective view of an elevator 100 having a pair of doors 104, 106 in an open position and a plurality of slips 122 in a first or "upper" position, according to an embodiment. The elevator 100 may be configured for use in drilling, casing, or other types of tubular running systems. Accordingly, the elevator 100 may be configured to support the weight of a tubular and lower the tubular into connection with a subjacent (i.e., already run) tubular as part of a string of tubulars such as a drill pipe or casing string. Further, the elevator 100 may be configured to lower the tubular, after being made up to the tubular string, into the wellbore, while supporting the weight of the tubular string. The elevator 100 may also be configured to allow the weight of the tubular string to be transferred to a spider or another structure located proximal the wellbore, and may then be disengaged from the tubular, lifted, and engaged with another tubular to repeat the process.

In particular, according to an embodiment, the elevator 100 may include a body 102 having the doors 104, 106 coupled therewith. The body 102 may include a top 107 and a bottom 109 and may form at least a portion of a cylindrical structure. In some cases, the doors 104, 106 may be omitted, with the body 102 providing the entire cylindrical structure. In other cases, a single door, or three or more doors, may be employed. In the illustrated embodiment, the doors 104, 106 may be coupled with the body 102 so as to pivot with respect thereto. For example, the doors 104, 106 may be coupled with the body 102 via pins 108-1, 108-2 (pin 108-2 is not visible in FIG. 1), respectively. The doors 104, 106 are shown in an open position in FIG. 1. The body 102 and the doors 104, 106 may together define a bowl 115 (e.g., when the doors 104, 106 are closed). The bowl 115 may include a frustoconical surface 121, which may decrease in diameter proceeding from the top 107 to the bottom 109 of the body 102.

The elevator 100 may also include the slips 122 (eight are shown) that are at least partially disposed within the bowl 115. As shown, the slips 122 are circumferentially-offset from one another about a longitudinal centerline 103 through the body 102. Although eight slips 122 are shown in the illustrated embodiment, it will be appreciated that additional or fewer slips may be employed. As shown, one or more of the slips 122 may be coupled with each door 104, 106. Accordingly, these slips 122 may be configured to swing or pivot with the doors 104, 106.

Each slip 122 may include a carrier 160 and an insert 162. The carrier 160 may include an outer surface 164 that is shaped and sized to conform to the tapered inner surface 121 of the bowl 115. As such, the outer surface 164 of the carrier 160 may be tapered, and a thickness (measured radially from the longitudinal centerline 103) may increase from the bottom of the carrier 160 to the top of the carrier 160.

The insert 162 may be coupled with the carrier 160 via a dovetail connection 166 or any other suitable connection. As shown, the insert 162 includes the male portion of the dovetail connection 166, and the carrier 160 includes the female portion of the dovetail connection 166, but in other embodiments, this configuration may be reversed.

Each insert 162 may include a first or "lower" portion 168 and a second or "upper" portion 170. The lower portion 168 may include a radial engaging surface 172 that faces the longitudinal centerline 103. The radial engaging surface 172 may be curved, e.g., partially around the longitudinal centerline 103. However, the radial engaging surface 172 may be generally straight in the axial direction, in cross-section, such that the radial engaging surface 172 may extend generally parallel to the longitudinal centerline 103.

The radial engaging surface 172 of the lower portion 168 may include a plurality of gripping structures 174, which may be teeth extending inwardly therefrom (i.e., toward the longitudinal centerline 103) that are adapted to engage and grip a tubular. The gripping structures 174 may be conical, frustoconical, or any other shape suitable to grip (e.g., by gouging into) the tubular. The gripping structures 174 may be arranged in two or more substantially parallel rows, as shown, or the gripping structures 174 may be arranged in any other suitable orientation.

The upper portion 170 of each insert 162 may include a tapered engaging surface 176 that faces the longitudinal centerline 103. The tapered engaging surface 176 of the upper portion 170 may be inclined at an angle to the longitudinal centerline 103 in radial cross-section. The angle may be from a low of about 1° to about 10°, about 10° to about 20°, about 20° to about 30°, about 30° to about 40°, about 10° to about 30°, or about 15° to about 25°. As such, the tapered engaging surface 176 may form a shoulder such that a distance between the bottom of the tapered engaging surface 176 and the longitudinal centerline 103 is less than a distance between the top of the tapered engaging surface 176 and the longitudinal centerline 103. As discussed in greater detail below with respect to FIG. 5, the tapered engaging surface 176 is adapted to receive and engage a corresponding shoulder or upset of a tubular (e.g., a drill pipe).

The slips 122 may be connected together via a timing ring (not shown). The timing ring may be coupled with or extend through one or more linkages 178 extending from the carrier 160 of each slip 122. One or more hydraulic or pneumatic cylinders (not shown) may be coupled with and disposed between the body 102 and the timing ring. The hydraulic cylinders may be extensible upward and downward with respect to the body 102, so as to drive the timing ring away from or toward the body 102. As the timing ring moves the slips 122 upward (e.g., away from) the body 102, the slips 122 may slide up along the surface 121 of the bowl 115, thereby increasing their radial distances from the longitudinal centerline 103, because the surface 121 of the bowl 115 is frustoconical. This moves the slips 122 into the first or "upper" position, as shown in FIG. 1, where the slips 122 may move away from (i.e., disengage) a tubular disposed within the elevator 100.

The body 102 may also include ears 148, 150 (ear 150 is not visible in FIG. 1) extending therefrom, which may be configured to engage bails of a travelling block or another component of a drilling rig. This may allow the elevator 100 to be moved (e.g., lifted and lowered) at least, so as to enable control of the position of a tubular that the elevator 100 engages.

Figure 2:
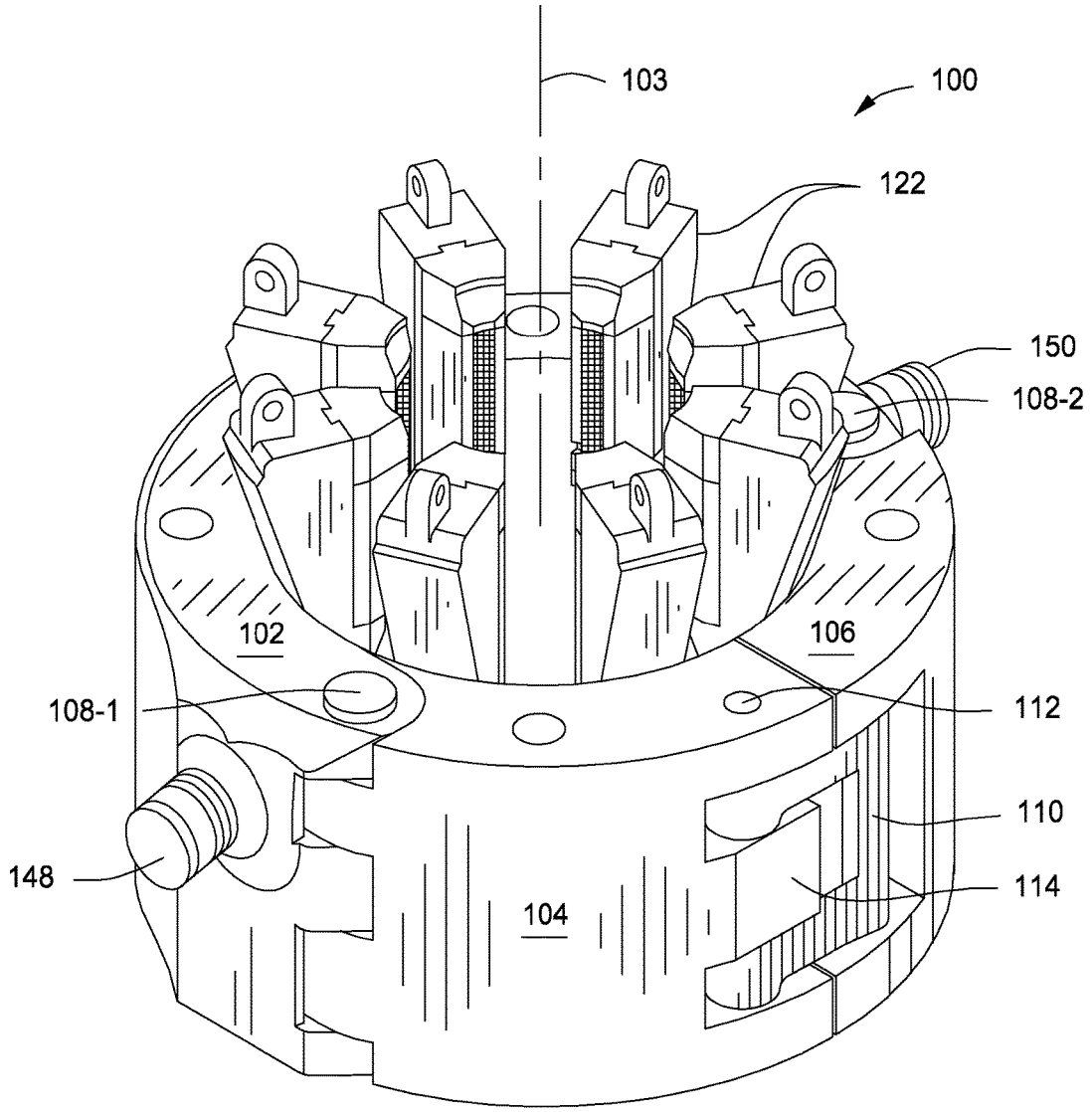
FIG. 2 illustrates a perspective view of the elevator having the doors in a closed position, according to an embodiment.

FIG. 2 illustrates a perspective view of the elevator 100 having the doors 104, 106 in a closed position, according to an embodiment. The doors 104, 106 may pivot about the pins 108-1, 108-2 into the closed position. When closed, the doors 104, 106 may be restrained together via a latch 110. The latch 110 may be pivotally coupled with the door 104 via a pin 112, and may be receivable between one or more knuckles (one is shown, 114) of the opposite door 106. When the doors 104, 106 are closed, the body 102 and the doors 104, 106 may form a generally cylindrical structure adapted to receive a tubular therein.

Figure 3:
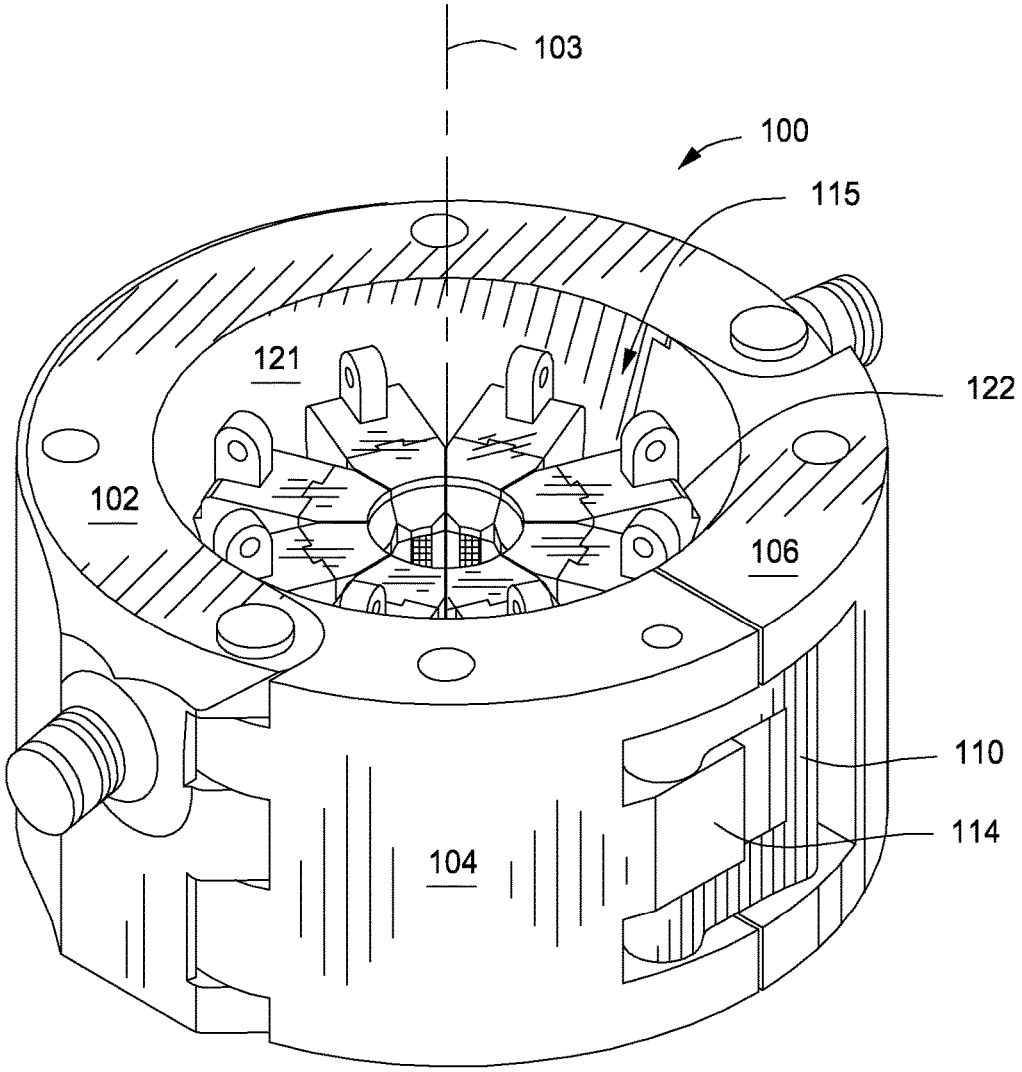
FIG. 3 illustrates a perspective view of the elevator having the doors in the closed position and the slips in a second or "lower" position, according to an embodiment.

FIG. 3 illustrates a perspective view of the elevator 100 having the doors 104, 106 in the closed position and the slips 122 in a second or "lower" position, according to an embodiment. As the timing ring (not shown) moves the slips 122 downward with respect to the body 102, the slips 122 may slide down along the surface 121 of the bowl 115, thereby decreasing their radial distances from the longitudinal centerline 103 (because the surface 121 bowl 115 is frustoconical). This moves the slips 122 into the second or "lower" position, as shown in FIG. 3, where the slips 122 may move toward a tubular disposed within the elevator 100 to contact, grip, or otherwise engage the tubular.

Figure 4:
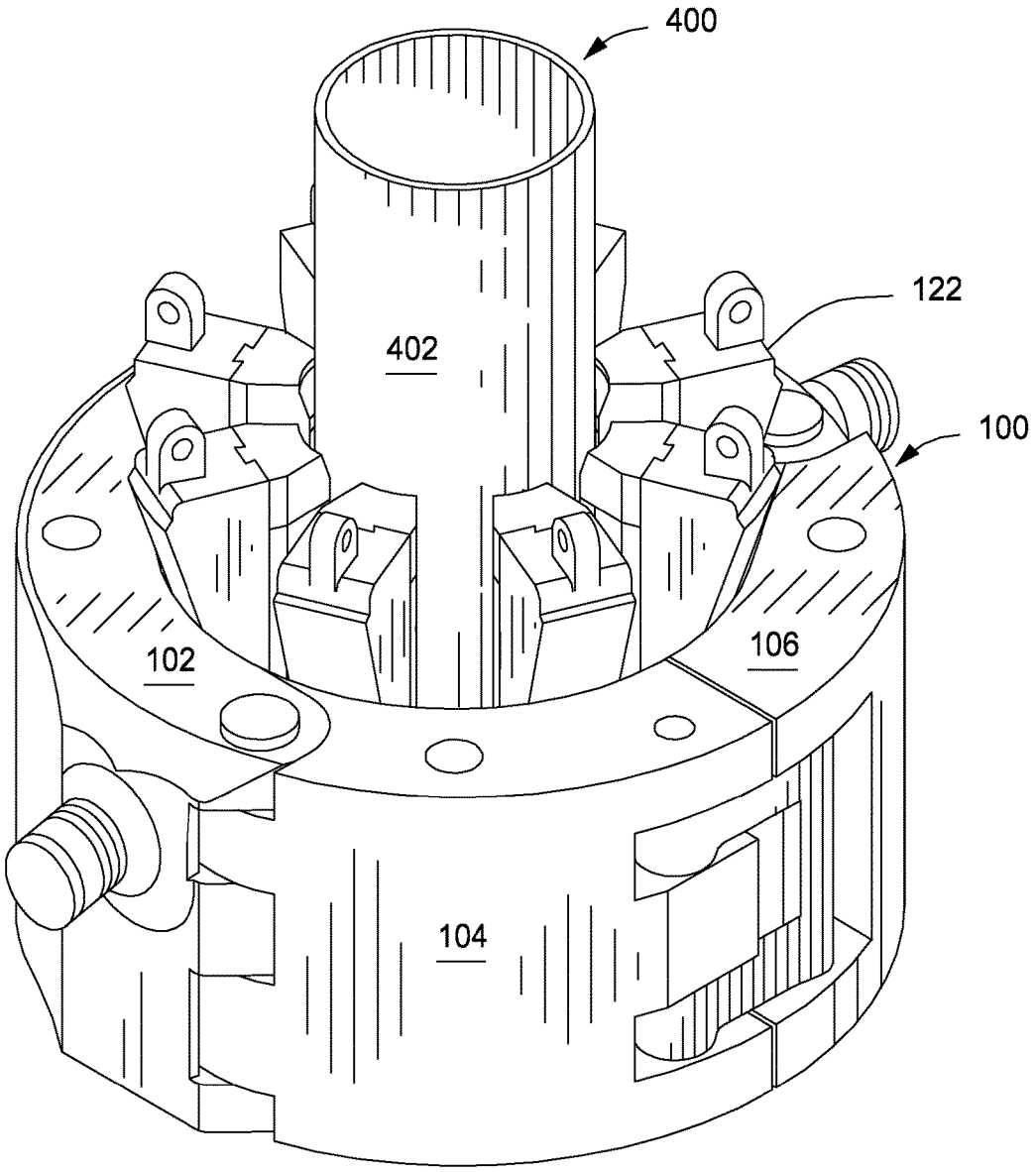
FIG. 4 illustrates a perspective view of the elevator having the doors in the closed position and the slips engaging the outer surface of a casing, according to an embodiment.

FIG. 4 illustrates a perspective view of the elevator 100 having the doors 104, 106 in the closed position and the slips 122 engaging the outer diameter or surface 402 of a casing 400, according to an embodiment. A tubular, such as a casing 400 having a substantially constant outer diameter, may be inserted into the elevator 100 either axially or laterally. The elevator 100 may be employed regardless of the starting orientation of the casing 400. That is, the casing 400 may begin in a horizontal orientation, a vertical or "racked back" orientation, or at any angle in between.

The casing 400 may be inserted into the elevator 100 when the doors 104, 106 of the elevator 100 are open, and then the doors 104, 106 may be closed and latched. In other cases, the doors 104, 106 may be and remain closed, and the casing 400 may be inserted axially (e.g., upward or downward as shown) into the elevator 100 in a direction parallel to the longitudinal centerline 103. Once the casing 400 is in place within the elevator 100, the timing ring may move the slips 122 downward with respect to the body 102 causing the slips 122 to simultaneously move radially-inward. When this occurs, the gripping structures 174 on the radial engaging surfaces 172 of the inserts 162 (see FIG. 1) may contact, grip, or otherwise engage and support the weight of the casing 400. If the casing 400 started in a horizontal orientation or an otherwise non-vertical orientation, the elevator 100 may hoist the casing 400 into a vertical position prior to use.

Figure 5:
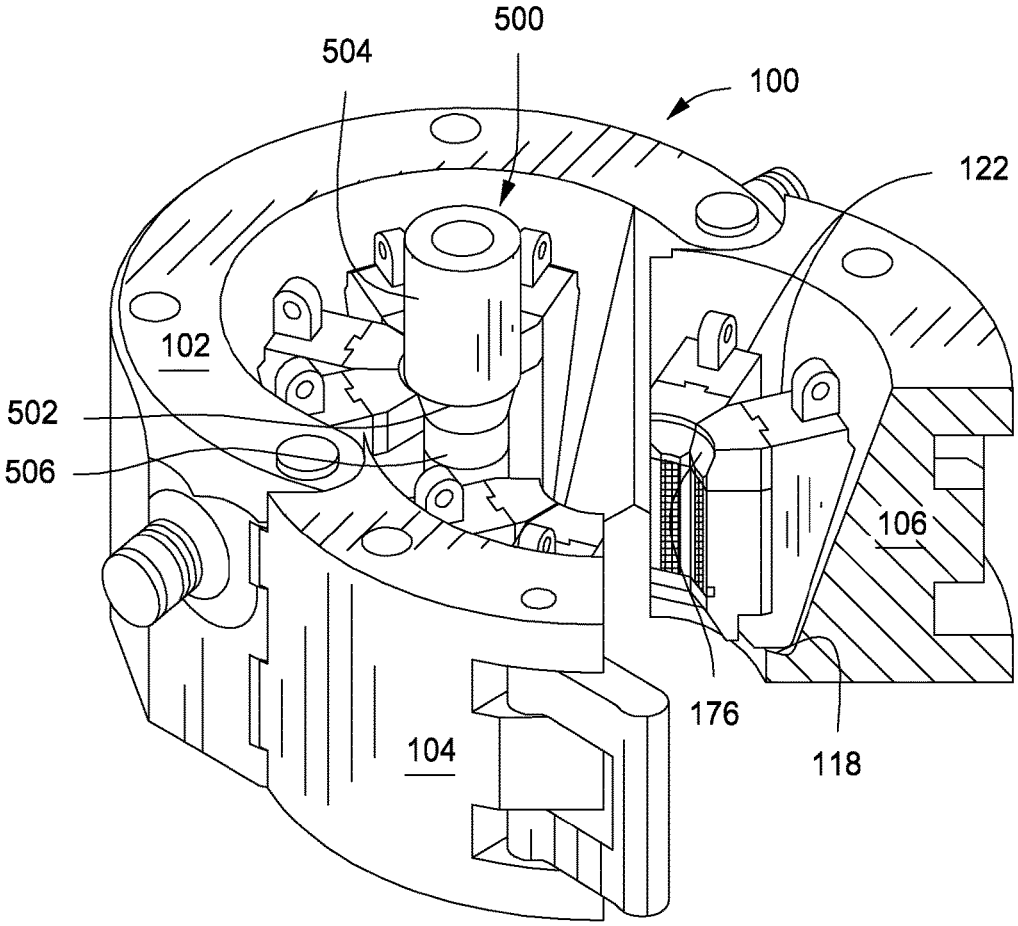
FIG. 5 illustrates a perspective view of the elevator having the doors in the open position and tapered engaging surfaces of (some of) the slips engaging an upset of a drill pipe, according to an embodiment.

FIG. 5 illustrates a perspective view of the elevator 100 having the doors 104, 106 in the open position and (some of) the slips 122 engaging a drill pipe 500, according to an embodiment. The elevator 100 may also receive a tubular, such as a drill pipe 500 having a tapered outer diameter or surface 502. The drill pipe 500 may include a tool joint 504 and a main body 506. The outer surface of the drill pipe 500 may taper down from the tool joint 504 to the main body 506, forming the tapered surface 502 (e.g., a shoulder or upset). Although not shown, in another embodiment, the tapered surface 502 may be omitted and replaced by a lift nubbin connected to the top of the tubular 500.

The elevator 100 may be employed regardless of the starting orientation of the drill pipe 500. That is, the drill pipe 500 may begin in a horizontal orientation, a vertical or "racked back" orientation, or at any angle in between. The drill pipe 500 may be inserted into the elevator 100 when the doors 104, 106 of the elevator 100 are open, and then the doors 104, 106 may be closed and latched. In other cases, the doors 104, 106 may be and remain closed, and the drill pipe 500 may be inserted axially (e.g., upward or downward as shown) into the elevator 100 in a direction parallel to the longitudinal centerline 103. Once the drill pipe 500 is in place within the elevator 100, the timing ring (not shown) may move the slips 122 upward or downward with respect to the body 102 causing the slips 122 to move radially-inward or radially-outward. The slips 122 may be moved to cause the tapered engaging surfaces 176 on the upper portions 170 of the inserts 162 (see FIG. 1) to contact and support the tapered outer surface 502 of the drill pipe 500.

When the slips 122 are in the second, lower position, the slips 122 may contact a landing surface 118. The landing surface 118 may prevent the slips 122 from continued downward travel in the bowl 115, providing for load transfer while preventing the slips 122 from moving radially-inward against the drill pipe 500. As shown, the landing surface 118 may be reverse tapered, meaning that the landing surface 118 may slope downward as it proceeds radially-outward. If the drill pipe 500 started in a horizontal orientation, the elevator 100 may hoist the drill pipe 500 into a vertical position prior to use.

In at least one embodiment, the inserts 162 may be switched out or replaced with inserts having a different size, depending on the size of the drill pipe 500, to better fit the outer surface 502 of the drill pipe 500. This may provide additional flexibility to the elevator 100.

Once the casing 400 and/or the drill pipe 500 are engaged and supported by the slips 122, the weight of the casing 400 and/or the drill pipe 500 may be transferred to the body 102 through the slips 122 engaging the bowl 115. In turn, the elevator 100 may transmit the force through the ears 148, 150 to bails attached to a lifting mechanism, so as to control the position of the casing 400 and/or the drill pipe 500 (e.g., to lower the casing 400 and/or the drill pipe 500 into a wellbore).

Figure 6:
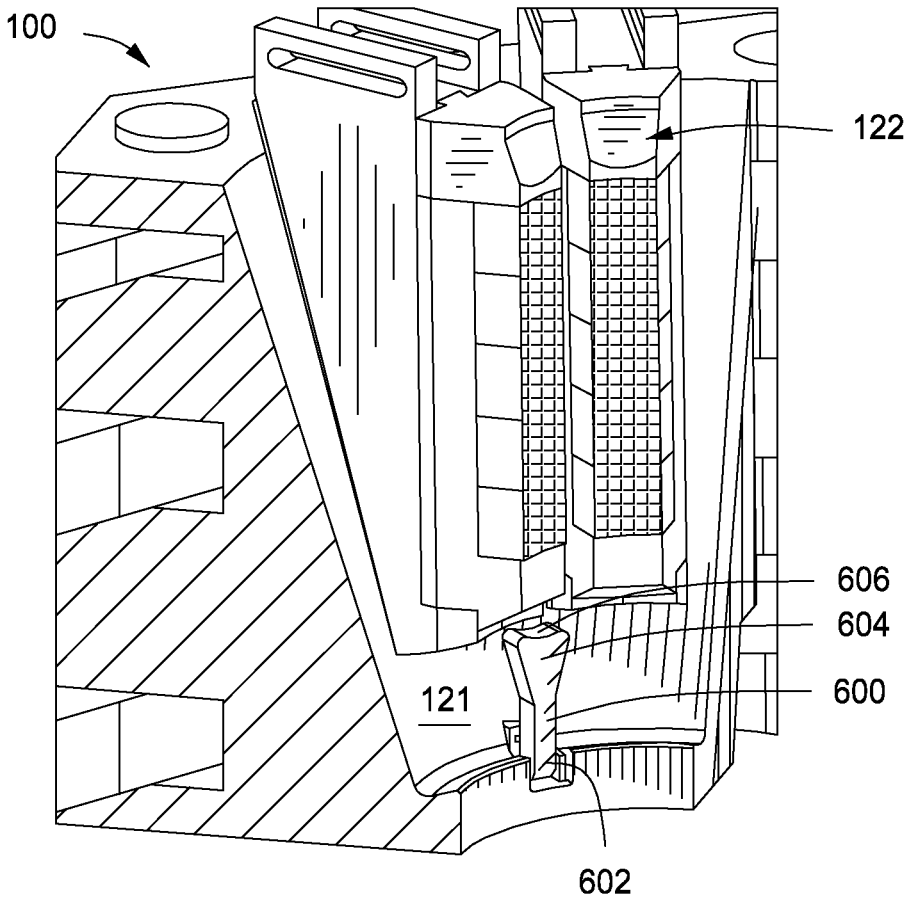
FIG. 6 illustrates a perspective view of a pipe guide coupled to the inner surface of the elevator and positioned below a corresponding slip, according to an embodiment.

FIG. 6 illustrates a perspective view of a pipe guide 600 coupled to the inner surface 121 of the elevator 100 and positioned below a corresponding slip 122, according to an embodiment. A first end 602 of the pipe guide 600 may be coupled with the inner surface 121 of the elevator 100 via a pin 603 (see FIG. 7). The pipe guide 600 may be adapted to pivot about the pin, as described in more detail below with reference to FIG. 8. A second, distal end 604 of the pipe guide 600 may include an outer surface 606. The outer surface 606 may have a radius of curvature that is shaped and sized to substantially conform to the curved outer surface of the main body 506 of the drill pipe 500 (see FIG. 5).

Figure 7:
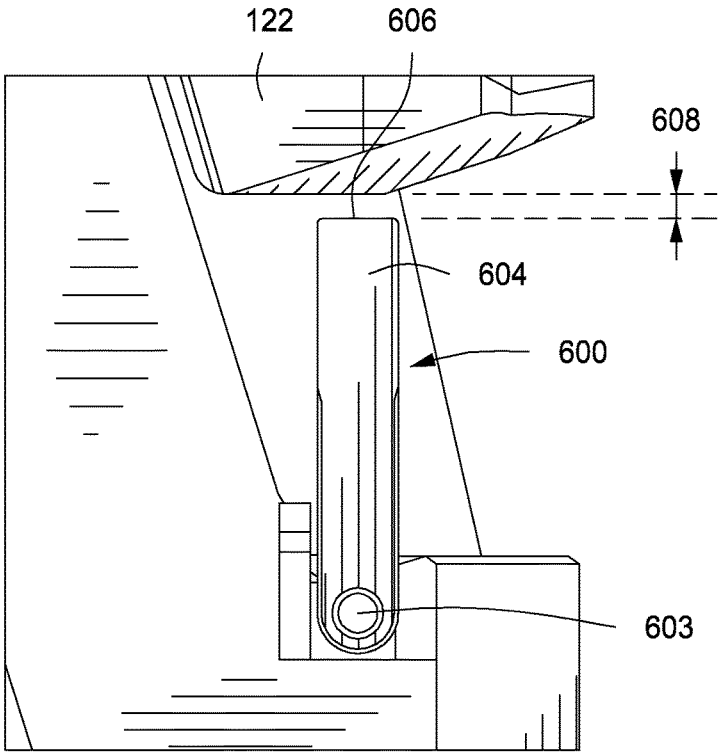
FIG. 7 illustrates a cross-sectional side view of the pipe guide in a first or "disengaging" position, according to an embodiment.

FIG. 7 illustrates a cross-sectional side view of the pipe guide 600 in a first or "disengaging" position, according to an embodiment. The pipe guide 600 may be biased into a substantially vertical, disengaging position with the second end 604 above the first end 602. The bias may be achieved via a tension spring coupled to the body 102, a torsion spring positioned around the pin, and/or any other biasing device. When the slips 122 are in the disengaging position, as shown in FIG. 7 (also in FIGS. 1 and 2), a gap 608 may exist between the each slip 122 and the outer surface 606 of the corresponding pipe guide 600.

Figure 8:
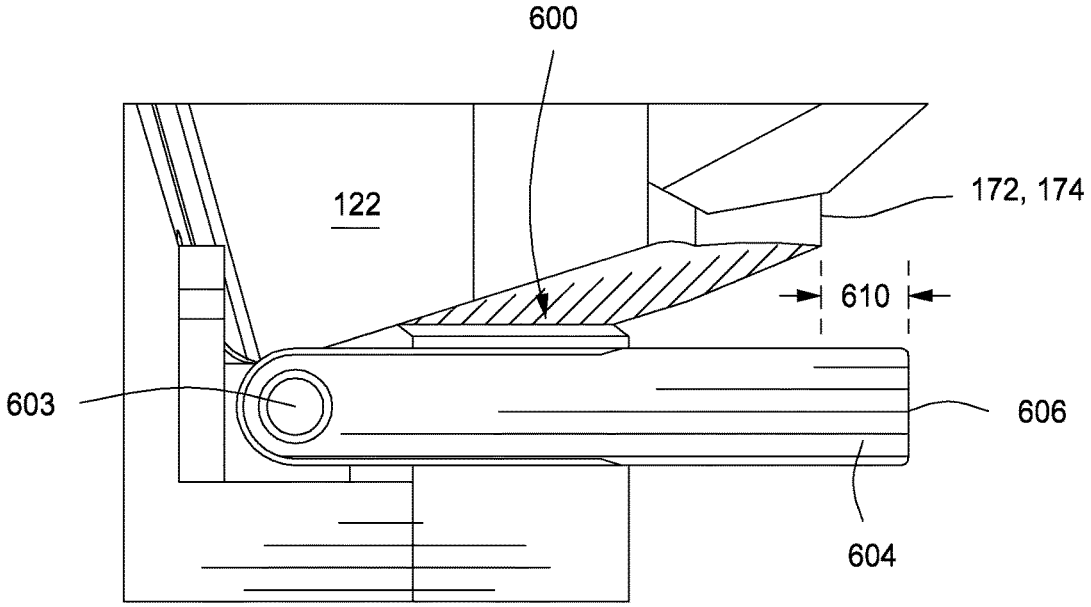
FIG. 8 illustrates a cross-sectional side view of the pipe guide in a second or "engaging" position, according to an embodiment.

FIG. 8 illustrates a cross-sectional side view of the pipe guide 600 in a second or "engaging" position, according to an embodiment. As the slips 122 move downward (into the engaging position), the slips 122 may contact the second ends 604 of the pipe guides 600. The slips 122 may exert a force on the pipe guides 600 that exceeds the force of the spring. As a result, the pipe guides 600 may pivot about their respective pins 603 about 90° into a substantially horizontal, engaging position. Although not shown, in other embodiments, the pipe guides 600 may pivot less than 90° (e.g., about 1° -about 89°. When the pipe guides 600 are in the substantially horizontal, engaging position, the outer surface 606 of each pipe guide 600 may extend inward (toward the longitudinal centerline 103) farther than the radial engaging surface 172 and gripping structures 174 of the corresponding slip 122 (see FIG. 1). The distance 610 between the radial engaging surface 172 and/or the gripping structures 174 of the slip 122 and the outer surface 606 of the pipe guide 600 may be from about 1 mm to about 3 mm, from about 2 mm to about 5 mm, from about 4 mm to about 8 mm, from about 6 mm to about 15 mm, or more. The first ends 602 of the pipe guides 600 may be in a recess, which allows the slips 122 to set down on the landing surface 118 without being obstructed by the pipe guides 600.

Figure 9:
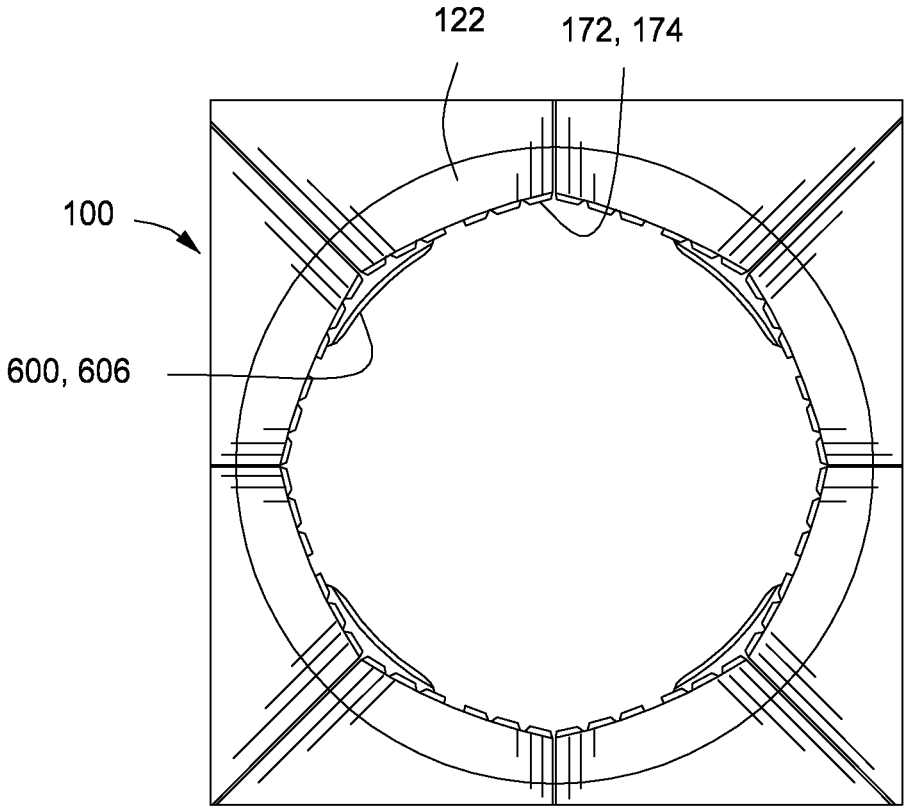
FIG. 9 illustrates a top view of a plurality of pipe guides in the engaging position, according to an embodiment.

FIG. 9 illustrates a top view of a plurality of pipe guides 600 in the engaging position, according to an embodiment. Four pipe guides 600 are shown circumferentially-offset from one another about the longitudinal centerline 103 (see FIG. 1). However, as may be appreciated, additional or fewer pipe guides 600 may be employed. When in the engaging position, the outer surfaces 606 of the pipe guides 600 may contact and stabilize the main body 506 of the drill pipe 500 (see FIG. 5), thereby preventing the main body 506 of the drill pipe 500 from contacting (and potentially being damaged by) the gripping structures 174 on the radial engaging surface 172 of the slip 122.

Figure 10:
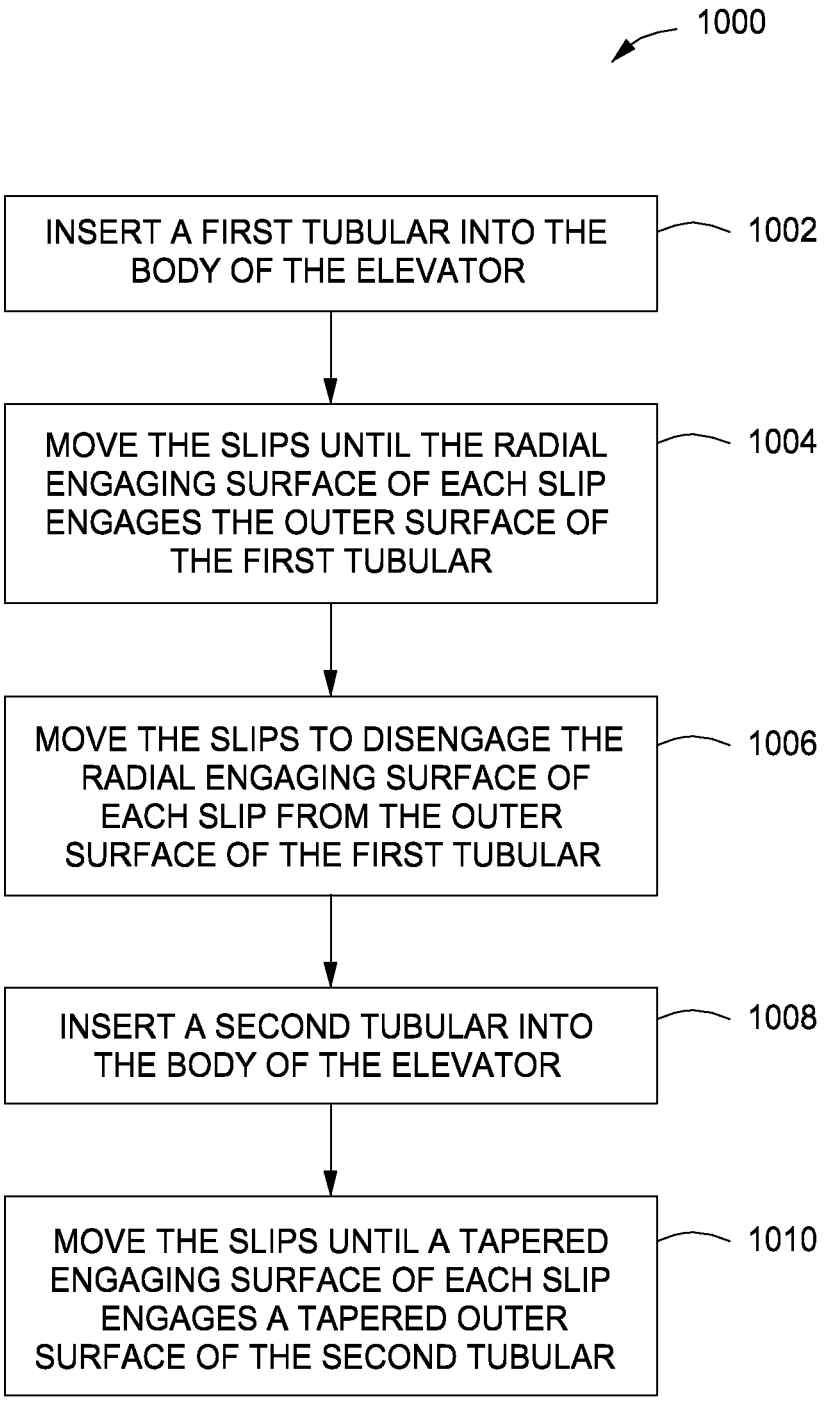
FIG. 10 illustrates a flowchart of a method for handling one or more tubulars, according to an embodiment.

FIG. 10 illustrates a flowchart of a method 1000 for handling a tubular, according to an embodiment. One or more embodiments of the method 1000 may proceed by operation of the elevator 100; therefore, the method 1000 is described with respect thereto. However, it will be appreciated that the method 1000 is not intended to be limited to any particular structure unless otherwise expressly stated herein.

The method may begin by inserting a first tubular (e.g., casing 400) into the body 102 of the elevator 100, as at 1002. As discussed above, the first tubular 400 may be inserted into the body 102 either laterally (e.g., through the open doors 104, 106) or axially. The slips 122 may move along the surface 121 of the bowl 115 until the radial engaging surface 172 of each slip 122 engages the outer surface 402 of the first tubular 400, as at 1004. Once engaged, the elevator 100 may move the first tubular 400. In at least one embodiment, the elevator 100 may lower the first tubular 400 into a wellbore. The slips 122 may then move in an opposing direction to disengage the radial engaging surface 172 of each slip 122 from the outer surface 402 of the first tubular 400, as at 1006.

The method 1000 may also include inserting a second tubular (e.g., drill pipe 500) into the elevator 100, as at 1008. The slips 122 may move along the surface 121 of the bowl 115 until the tapered engaging surface 176 of each slip 122 engages the tapered outer surface 502 of the second tubular 500, as at 1010. Once engaged, the elevator 100 may move (e.g., lower) the second tubular 500.

It will be appreciated that terms implying an orientation, such as "above," "below," "top," "bottom," "up," "down," "left," "right," and the like, are used for convenience in referring to the Figures. Such terms are merely indicative of relative position and are not to be considered as limiting the elevator 100 to any particular orientation.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for handling one or more tubulars, comprising:

a body defining at least a portion of a tapered bowl; and a plurality of slips disposed at least partially within the bowl and configured to slide along a surface of the bowl, wherein each of the slips comprises:

a radial engaging surface having a plurality of gripping structures extending inwardly from the radial engaging surface that are configured to engage an outer surface of a first tubular having a substantially constant outer diameter; and a tapered engaging surface configured to engage a tapered outer surface of a second tubular.

2. The apparatus of claim 1, wherein the radial engaging surface is parallel to a longitudinal centerline through the body.

3. The apparatus of claim 2, wherein a distance between the gripping structures and the longitudinal centerline is less than a distance between the tapered engaging surface and the longitudinal centerline.

4. The apparatus of claim 1, wherein the radial engaging surface is positioned below the tapered engaging surface.

5. The apparatus of claim 1, wherein the tapered engaging surface is inclined relative to a longitudinal centerline through the body at an angle of between about 10 degrees and about 30 degrees.

6. The apparatus of claim 1, wherein the tapered bowl is inclined relative to a longitudinal centerline through the body at an angle of between about 10 degrees and about 30 degrees.

7. The apparatus of claim 6, wherein each of the slips comprises a carrier having an outer surface that is inclined relative to the longitudinal centerline at an angle of between about 10 degrees and about 30 degrees, and wherein the outer surface is configured to contact and slide along the surface of the bowl.

8. The apparatus of claim 1, further comprising a pipe guide coupled to the body and positioned below the slips, wherein the pipe guide is configured to pivot between a first position and a second position when contacted by one or more of the slips.

9. The apparatus of claim 8, wherein a distance between an end of the pipe guide and a longitudinal centerline through the body is less than a distance between the gripping structures on the radial engaging surface and the longitudinal centerline when the pipe guide is in the second position.

10. An apparatus for handling one or more tubulars, comprising:

a body defining at least a portion of a tapered bowl; and a plurality of slips disposed at least partially within the bowl and configured to slide along a surface of the bowl, wherein each of the slips comprises:

a carrier having an outer surface that is inclined relative to a longitudinal centerline through the body at an angle of between about 10 degrees and about 30 degrees, wherein the outer surface is configured to contact and slide along the surface of the bowl; and an insert coupled with the carrier via a dovetail connection, wherein the insert comprises:

a radial engaging surface having a plurality of gripping structures extending inwardly from the radial engaging surface that are configured to engage an outer surface of a first tubular having a substantially constant outer diameter; and a tapered engaging surface configured to engage a tapered outer surface of a second tubular.

11. An elevator for handling one or more tubulars, comprising:

a body defining a first portion of a tapered bowl;

one or more doors pivotally coupled with the body, wherein the one or more doors define a second portion of the bowl;

a plurality of slips disposed at least partially within the bowl and circumferentially-offset from one another about a longitudinal centerline through the body, wherein the slips are configured to slide along a surface of the bowl, and wherein each of the slips comprises:

a radial engaging surface having a plurality of gripping structures extending inwardly from the radial engaging surface that are configured to engage an outer surface of a first tubular having a substantially constant outer diameter; and a tapered engaging surface configured to engage a tapered outer surface of a second tubular; and a plurality of pipe guides coupled to the body and positioned below the slips, wherein each of the pipe guides is configured to pivot between a first position and a second position when contacted by one of the slips.

12. The elevator of claim 11, wherein the radial engaging surface is parallel to the longitudinal centerline, and wherein the tapered engaging surface is inclined relative to the longitudinal centerline at an angle of between about 10 degrees and about 30 degrees.

13. The elevator of claim 12, wherein a distance between the gripping structures and the longitudinal centerline is less than a distance between the tapered engaging surface and the longitudinal centerline.

14. The elevator of claim 13, wherein the radial engaging surface is positioned below the tapered engaging surface.

15. The elevator of claim 11, wherein at least one of the slips slides along the second portion of the bowl defined by the one or more doors.

16. A method for handling one or more tubulars, comprising:

inserting a first tubular having a substantially constant outer diameter into a body of an elevator, wherein the body defines at least a portion of a tapered bowl, and wherein a plurality of slips are disposed at least partially within the bowl;

moving the slips along a surface of the bowl until a radial engaging surface of each slip engages an outer surface of the first tubular;

moving the slips along the surface of the bowl to disengage the radial engaging surface of each slip from the outer surface of the first tubular;

inserting a second tubular into the elevator; and moving the slips along the surface of the bowl until a tapered engaging surface of each slip engages a tapered outer surface of the second tubular.

17. The method of claim 16, further comprising moving the first tubular with the elevator when the radial engaging surfaces of the slips are engaged with the outer surface of the first tubular.

18. The method of claim 16, wherein the first tubular is a casing, and wherein the second tubular is a drill pipe.

19. The method of claim 16, wherein moving the slips along the surface of the bowl until the tapered engaging surface of each slip engages the tapered outer surface of the second tubular comprises moving the slips downward and radially-inward with respect to a longitudinal centerline through the body.

20. The method of claim 19, further comprising:

contacting a pipe guide with one or more of the slips as the slips move downward and radially-inward; and moving the pipe guide from a first position to a second position in response to the contact with the one or more slips, wherein an end of the pipe guide engages a portion of the outer surface of the second tubular having a substantially constant diameter to prevent the second tubular from contacting the radial engaging surface of the one or more slips.

21. An apparatus for handling one or more tubulars, comprising:

a body defining at least a portion of a tapered bowl; and a plurality of slips positioned at least partially within the bowl and configured to slide along a surface of the bowl, wherein each of the slips comprises:

a radial engaging surface configured to engage a portion of a first tubular, wherein the portion of the first tubular has a substantially constant outer diameter; and a load-bearing surface configured to engage a first portion of a second tubular, wherein the first portion of the second tubular has a varying outer diameter proceeding in an axial direction, and wherein a gap is formed between the radial engaging surface and the second tubular when the load-bearing surface engages the first portion of the second tubular.

22. The apparatus of claim 21, wherein the gap is formed between the radial engaging surface and a second portion of the second tubular, wherein the second portion of the second tubular has a substantially constant outer diameter.

23. The apparatus of claim 21, wherein the load-bearing surface is tapered at substantially a same angle as the first portion of the second tubular.

24. The apparatus of claim 23, wherein the load-bearing surfaces of the plurality of slips together define a conical geometry when the plurality of slips are brought circumferentially together.

25. The apparatus of claim 21, further comprising a pipe guide coupled to the body and positioned below the slips, wherein the pipe guide is configured to pivot between a first position and a second position when contacted by one or more of the slips.

26. The apparatus of claim 21, wherein the bowl is at least partially conical, and wherein exterior surfaces of the plurality of slips form a conical geometry when the plurality of slips are brought together within the bowl.

* * * * *